United States Patent [19]

Buczkowski

[11] Patent Number: 4,627,356

[45] Date of Patent: Dec. 9, 1986

[54] TWO-PIECE BOOSTER SHOT SHELL WAD

[76] Inventor: Louis Buczkowski, 1332 E. Seventh St., Erie, Pa. 16503

[21] Appl. No.: 743,620

[22] Filed: Jun. 11, 1985

[51] Int. Cl.[4] ..... F42B 7/08

[52] U.S. Cl. ..... 102/453; 102/532

[58] Field of Search ..... 102/448–463, 102/532

[56] References Cited

U.S. PATENT DOCUMENTS

| | | | |
|---|---|---|---|
| 3,420,178 | 1/1969 | Rempel | 102/453 |
| 3,469,527 | 9/1969 | Pace | 102/451 |
| 3,516,360 | 6/1970 | Lathrope et al. | 102/451 |
| 3,669,023 | 6/1972 | Moehlman et al. | 102/453 |
| 3,788,224 | 1/1974 | Merritt | 102/450 |
| 3,974,775 | 8/1976 | Keizman et al. | 102/451 |
| 4,506,605 | 3/1985 | Maki | 102/457 |

*Primary Examiner*—Harold J. Tudor

*Attorney, Agent, or Firm*—Charles L. Lovercheck; Wayne L. Lovercheck; Dale R. Lovercheck

[57] ABSTRACT

A two piece booster shot shell wad is disclosed which includes a one piece wad unit and a shot cup. The shot cup is received in a cup shaped cavity in the one piece unit. The shot cup has a non-circular stud on its bottom and is received in a non-circular recess on the one piece wad. The one piece wad has a channel on its bottom to trap air and direct it against the bottom of said shot cup to expel the shot cup from the one piece wad. The over powder wad shapes the charge and extended primer flash pocket helps in ignition of the powder. The outer peripheral upper edges of the cup shaped cavity in the one piece unit is flared outwardly to build up air pressure for opening the ears of the one piece wad and the shot cup has spaced ears which flare outwardly in flight through the air.

11 Claims, 4 Drawing Figures

TWO-PIECE BOOSTER SHOT SHELL WAD

BACKGROUND OF THE INVENTION

Prior shot gun shells that contain powder and shot have the shot supported between an over powder wad between the powder and the shot. This allows the shot to scatter when the gun is fired. Some prior shot gun shells utilized wads wherein the first part of a wad was a shot cup which received the shot. The shot cup sides flared out in flight so that the shot left the shot cup and tended to scatter when they left the wad in flight.

GENERAL STATEMENT OF THE INVENTION

Applicant has provided a two piece booster shot shell wad to fit in an ordinary shell case combination. The combination is made up of a one piece wad unit having a shot cup receiving member and an over powder wad. The shot cup receiving member is made of either three or four segments which attach to the shot cup receiving member bottom and to the over powder wad. The shot cup receiving member is integral with the over powder wad. The inside of the bottom of the shot cup receiving member has an air pressure ring cavity formed in it. It has a central cavity which will accept a stud on the outside of the bottom of the shot cup. Pillars are provided for supporting the shot cup receiving member on the over powder wad. The shot cup container may have three segments or four segments forming straight walls. Serrations are formed on the exterior side of the bottom. The stud on the bottom of the shot cup determines the relationship of spaced segments on the shot cup receiving member and the segments on the shot cup.

When the gun is fired, the flash from primer enters and ignites the powder. The extended flash pocket helps promote ignition of the powder. The flash pocket is especially helpful with slow burning powder. The shape of the extended flash pocket is like a shaped powder charge enhancing the ignition of the powder and increasing force exerted on the inner base of the shell case. When the gun is fired the one piece wad moves forward in the shell case opening the crimp on the shell case. Wad and shot cup travel down the barrel of the gun with the charge of shot in the shot cup. Compressing the ring on the bottom of the over powder wad helps stop gas leakage while wad is in the barrel. As the shot cup with the shot charge exits the gun barrel, air pressure on the flared rim on the front end of the shot cup receiving member begins to open the wad segments. Air pressure flows between the shot cup receiving member of wad and shot cup serrations entering the air pressure ring recess. After forward pressure is almost equalized between wad and shot cup, air pressure built up in the pressure ring recess pushes the shot cup out of the shot cup container. As Wad and shot cup begin to separate, more air pressure builds up in the stud cavity in the wad, and that pressure build up helps to push the shot cup out of the receiving member. The shot is thus contained for a longer period of time in shot cup, enabling the shot to be concentrated for a longer period of time. When the shot cup separates from the wad the shot cup travels further down range. Then the ears on the shot cup are forced open by air resistance to dispense shot in a more concentrated pattern enabling more shot on the target at longer ranges.

OBJECTS OF THE INVENTION

It is an object of the invention to provide an improved two piece booster shot shell wad.

Another object of the invention is to provide a two piece wad with four segments or ears and a bottom. The bottom of the cup having an air pressure ring cavity which traps air to expel the shot cup from the two piece wad during flight.

Another object of the invention is to provide an improved wad arrangement for a shot gun shell.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
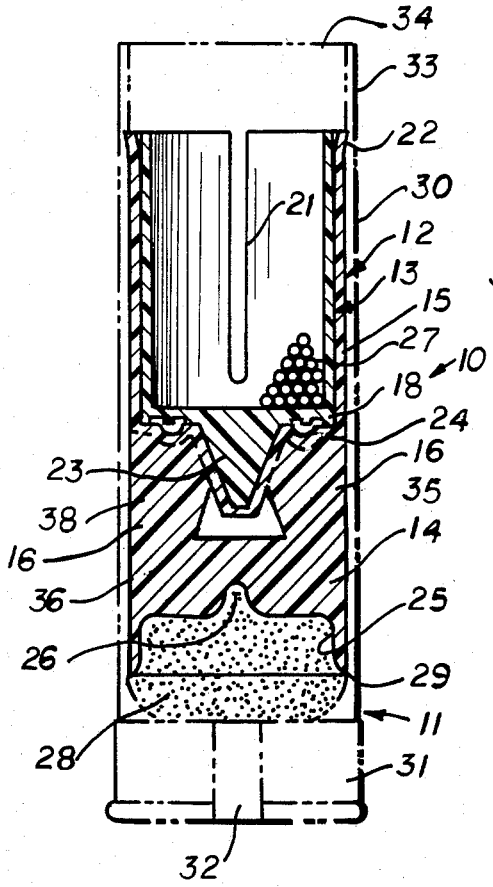
FIG. 1 is a longitudinal cross sectional view of the two piece booster shot shell wad in a conventional shell case according to the invention.
Figure 2:
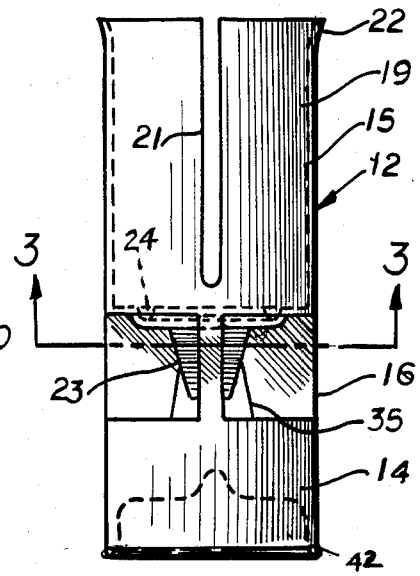
FIG. 2 is a side view of the one piece wad unit.
Figure 3:
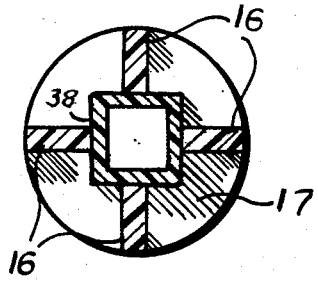
FIG. 3 is a lateral cross sectional view taken on line 3—3 of FIG. 2.
Figure 4:
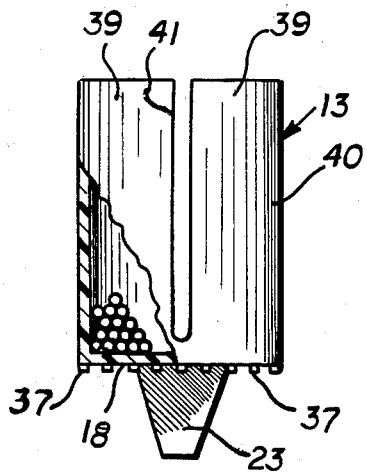
FIG. 4 is a side view partly in cross section of a shot cup for use in the one piece wad shown in FIG. 2.

Now with more particular reference to the drawings, I show a combination 10, a wad 12 to be received in a shell case 11 and shot cup 13. The wad 12 has a concave over powder wad 14, a shot cup receiving container 15 and pillars 16 supporting the shot cup receiving container 15 on the over powder wad 14. The pillars 16 are resilient and store certain energy the instant of firing which is released to the shot immediately after firing. These pillars connect the shot cup container 15 to the over powder wad 14. The shot cup container 15 has a disk like bottom 17 and upwardly extending cylindrical segments 19 that define a cylindrical surface having slots 21 that separate the segments 19 and extend from the open end of the container to the bottom. The bottom 17 of the shot cup container 12 has an annular recess 24 which provides a space for air pressure to build up an instant after firing.

Stud receiving member 38 is attached to the bottom of the shot cup receiving member just inward of member 38. The underside of the over powder wad 14 has a concave surface 25 with a flash pocket 26 formed in it which overlies the powder 28. The lower end of the one piece wad has a downwardly extending cup like flange that defines a compression ring 29 and has a sharp outwardly extending inner cup like surface which causes the compression ring 29 to flare outwardly and make sliding engagement with the inner surface of the bore of the gun acting as a piston ring on the wad as gas pressure forces the wad outward in firing.

The over powder wad 14 has a cylindrical outer periphery 36 and upwardly extending central support member 35 which has a cavity in its upper end that receives the lower end of the stud receiving member 38 which receives the stud 23 of the shot cup.

The conventional shell case 11 has a generally hollow cylindrical side wall with a base 31 which contains a primer 32 and the upper end of the cylindrical shell case has a crimp section 33 with an open end 34 of a type that will be familar to those skilled in the art.

The shot cup 13 has a disk like bottom 18 which rests on the disk like bottom 17 of the shot cup container 15. The shot cup 13 is generally in the form of a cup having the disk like bottom 18 and an open top and generally hollow cylindrical side walls 40. The side wall of the shot cup has slots 41 which extend from the rim 39 at upper end downwardly and terminate adjacent the disc like bottom 18 dividing the side walls into spaced segements.

The stud receiving member 38 on the lower side of the disk like bottom 17 has a hollow recess which receives the stud 23. The stud 23 being complimentary in shape to the recess 38. The stud may have any number of sides, either three, four or more, and it could be conical shaped and have a keyway on it to locate it. The shot cup has serration or recesses between protrusions 37 37 formed on its lower side which overlie the annular recess 24 in the top of the disc like bottom 17 of the shot cup receiving member and allow air caught by flare 22 to flow into annular recess 24 pushing shot cup 13 out of shot cup container 15.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a shell case and a two-piece booster shot shell wad comprising a shell case, a one-piece wad, a shot cup, said one piece wad having a concave over powder wad, a shot cup container, resilient pillars, said pillars connecting said shot cup container to said over powder wad, said shot cup container having a disk like bottom and cylindrical side walls terminating at a flared rim, said shot cup having a disk like bottom resting on said disk like bottom of said shot cup container, said shot cup having generally cylindrical side walls and an open top defining a hollow cylindrical cup having a rim terminating generally flush with said flared rim of said shot cup container, said shot cup side walls extending from said rim at said upper end downwardly and terminating at said disk like bottom of said shot cup container and having axial slots dividing said side walls into spaced segments.

2. The combination recited in claim 1 wherein said bottom of said shot cup container has an air pressure recess on the side thereof adjacent said shot cup, said bottom of said shot cup overlying said recess forming an air pressure chamber, said air pressure chamber being adapted to receive air under pressure for pushing said shot cup out of said shot cup container when powder below said powder wad is fired.

3. The combination recited in claim 1 wherein said over powder wad has a concave downwardly facing powder engaging surface, a flash pocket in the form of a slender opening in said concave surface at its center whereby said flash pocket enhances the ignition of said powder.

4. The combination recited in claim 2 wherein said over powder wad member has an upwardly extending concave support member thereon and means on said bottom of said shot cup resting on said concave surface.

5. The combination recited in claim 4 wherein said shot cup receiving member walls have segments with spaces between them and said shot cup walls have spaced segments, means to selectively align said spaces between said segments of said shot cup with said spaces between said segments of said cup receiving member walls.

6. The combination recited in claim 4 wherein means is fixed to the lower side of said shot cup cooperate with means on said shot cup receiving member for orienting said shot cup receiving member relative to said shot cup member.

7. The combination recited in claim 5 wherein the upper ends of said segments on said shot cup receiving member are flared outwardly.

8. The combination recited in claim 6 wherein said means on said shot cup for orienting said shot cup comprises a downwardly extending stud, noncircular in cross section, a cavity in said shot cup receiving member adapted to receive said stud on said shot cup, means on said recess for cooperating with said stud to orient said shot cup.

9. The combination recited in claim 7 wherein said cavity is complimentary in shape to said stud.

10. The combination recited in claim 8 wherein said stud is rectangular in cross section.

11. The wad recited in claim 9 wherein said bottom of said shot cup receiving member has an annular groove in the upper side thereof, said bottom of said shot cup resting on said bottom of said shot cup receiving member whereby air is trapped in said groove when said shot cup is received in said shot cup receiving member.

* * * * *